US006410158B1

(12) United States Patent
Johnson et al.

(10) Patent No.: US 6,410,158 B1
(45) Date of Patent: Jun. 25, 2002

(54) HIGH GLOSS COATED PAPER

(75) Inventors: Dean R. Johnson, Columbia; Eric D. Johnson, Flintstone, both of MD (US); James E. Shultz, Keyser, WV (US)

(73) Assignee: Westvaco Corporation, Stamford, CT (US)

( * ) Notice: Subject to any disclaimer, the term of this patent is extended or adjusted under 35 U.S.C. 154(b) by 0 days.

(21) Appl. No.: 09/788,701

(22) Filed: Feb. 21, 2001

Related U.S. Application Data

(62) Division of application No. 09/289,871, filed on Apr. 12, 1999, now Pat. No. 6,242,047.

(51) Int. Cl.[7] ..... B32B 23/04; B05D 3/12

(52) U.S. Cl. ..... 428/532; 428/535; 428/536; 428/537.5; 427/361; 427/366; 427/411; 427/395

(58) Field of Search ..... 427/361, 366, 427/411, 395; 428/532, 535, 536, 537.5

(56) References Cited

U.S. PATENT DOCUMENTS

| | | | | |
|---|---|---|---|---|
| 3,779,800 | A | 12/1973 | Heiser | 428/327 |
| 3,968,319 | A | 7/1976 | Mani et al. | 428/511 |
| 4,241,143 | A | 12/1980 | Ashie et al. | 428/512 |
| 4,265,969 | A | 5/1981 | Yasuda et al. | 428/342 |
| 4,963,604 | A | 10/1990 | Coco et al. | 524/17 |
| 5,360,657 | A | 11/1994 | Kano et al. | 428/207 |
| 5,521,253 | A | 5/1996 | Lee et al. | 525/301 |
| 6,242,047 | B1 * | 6/2001 | Johnson | 427/361 |
| 6,254,725 | B1 | 7/2001 | Lau et al. | 162/135 |

FOREIGN PATENT DOCUMENTS

| | | |
|---|---|---|
| EP | 0595723 | 5/1994 |
| WO | WO9820201 | 5/1998 |
| WO | 1045068 | 10/2000 |

OTHER PUBLICATIONS

"Plastic Pigments in Paper Coatings," by B. Alince and P. Lepoutre, published in TAPPI, May, 1980, vol. 63, No. 5, at pp. 49–53.

"Light Reflectance of Spherical Pigments in Paper Coating," by J. Borch and P. Lepoutre, published in TAPPI, Feb. 1978, vol. 61 No. 2, at pp. 45–48.

"Hollow–Sphere Polymer Pigment in Paper Coating," by J. E. Young, published in TAPPI, May 1985, vol. 68, No. 5, at pp. 102–105.

"Lighweight Coated Magazine Papers," published in the Jul. 5, 1976 issue of the Magazine Paper, vol. 186, No. 1, at pp. 35–38.

* cited by examiner

*Primary Examiner*—Leszek Kiliman

(57) ABSTRACT

A coated paper product having high gloss and brightness is prepared by a process wherein a paper substrate is coated on at least one side with an aqueous coating formulation comprising an effective amount of a plastic pigment, and finished in a supercalender device containing heated rolls to produce a surface which is comparable to a cast coated surface.

6 Claims, 1 Drawing Sheet

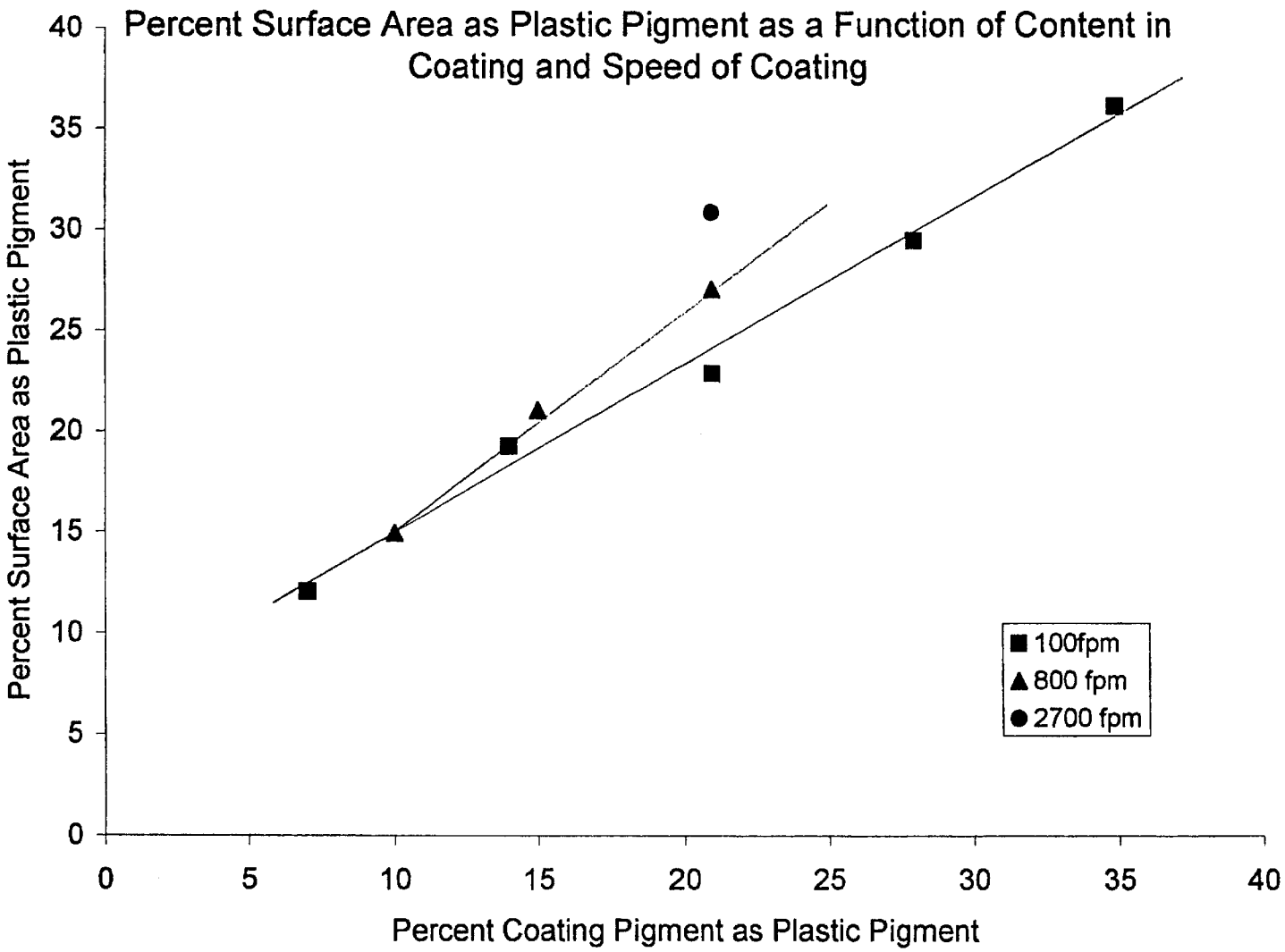
Percent Surface Area as Plastic Pigment as a Function of Content in Coating and Speed of Coating
Percent Surface Area as Plastic Pigment
Percent Coating Pigment as Plastic Pigment
0
5
10
15
20
25
30
35
40
100fpm
800 fpm
2700 fpm

HIGH GLOSS COATED PAPER

This application is a division of Application Ser. No. 09/289,871, filed Apr. 12, 1999, now U.S. Pat. No. 6,242,047.

BACKGROUND OF THE INVENTION

The present invention relates generally to a coated paper product having high gloss and brightness and the method of manufacturing such a product. In particular, the invention relates to a process for manufacturing a coated paper product with a surface comparable to a cast coated surface, that may be used, for example, as the facing sheet of a pressure sensitive laminate. In addition to this intended use, the product of the present invention is suitable for a variety of other printing and converting operations such as metallizing, foil laminating and printing, security label applications and, specialty packaging as well as upscale gift wrap and labels.

Such paper products have in the past been produced almost exclusively by a cast coating process. During cast coating, gloss development relies on a replication of the mirror-like finish on a dryer roll, as the applied coating is dried. However, production rates for the cast coating process are considerably slower than the production of coated paper on a high speed papermachine. Thus it would be desirable and advantageous to develop a high speed coating process that could be used to produce a cast coated surface on paper Examples of the cast coating process are disclosed in prior U.S. Pat. Nos. 4,241,143 and 4,301,210.

Another method for producing high gloss paper is disclosed in U.S. Pat. No. 5,360,657. In this patent, a process is disclosed in which a thermoplastic polymeric latex having a second order transition temperature of at least 80 degrees C., and an average particle size smaller than 100 microns is applied to paper which is subsequently calendered to produce high gloss. Other methods for producing high gloss paper include the application of a glossy overprint varnish onto a previously coated substrate. However, in the latter case, the glossy surface produced is not generally useful for offset printing because of the excessive ink drying time required.

It is also known, as disclosed for example in PCT published application WO 98/20201, that a printing paper having high brightness and gloss can be manufactured by applying to paper a coating comprising at least 80 parts precipitated calcium carbonate and at least 5 parts of an acrylic styrene copolymer hollow sphere plastic pigment. The published application also notes that a finishing step using a calender is required to achieve the gloss development, but the method of calendering is deemed to be not restrictive. Likewise, in an article entitled "Lightweight Coated Magazin Papers," published in the Jul. 5, 1976 issue of the magazine PAPER, Vol. 186, No. 1, at pages 35–38, a relationship between calendering and the use of plastic pigments in coatings is disclosed. The article notes that polymers such as polystyrene are thermoplastic and pressure sensitive, and a pigment based on polystyrene will exhibit a high degree of calendering response.

These and other publications including an article entitled "Light Reflectance of Spherical Pigments in Paper Coatings," by J. Borch and P. Lepoutre, published in TAPPI, February 1978, Vol. 61, No. 2, at pages 45–48; an article entitled "Plastic Pigments in Paper Coatings," by B. Aluice and P. Lepoutre, published in TAPPI, May 1980, Vol. 63, No. 5, at pages 49–53; and an article entitled "Hollow-Sphere Polymer Pigment in Paper Coating," by J. E. Young, published in TAPPI, May 1985, Vol. 68, No. 5, at pages 102–105, all recognize the use of polymer pigments in paper coatings, but none of these publications disclose the unique combination of coating formulation and finishing conditions disclosed herein.

SUMMARY OF THE INVENTION

The present invention relates generally to a coated paper product and method of producing it. More particularly, the invention relates to a coated paper product that can be manufactured on a high speed papermachine and still achieve a high gloss, high brightness surface typical of cast coated paper.

The coatings disclosed herein for practicing the present invention include conventional inorganic pigments such as clay and calcium carbonate in conjunction with elevated amounts of thermoplastic polymer latex beads. The beads are either hollow or solid in composition. Upon applying these coatings onto an uncoated but smoothened basestock, or onto a precoated basestock, it is possible to achieve a high gloss and smoothness with good printing properties when the coated surface is finished in a calendar device such as a supercalender containing heated rolls.

Paper produced with the high plastic pigment content coating preferred for the present invention is suitable for printing using conventional printing methods including sheet-fed litho offset, flexography, rotogravure and web offset.

The high gloss coatings of the present invention comprise standard coating pigments such as clay, ground or precipitated calcium carbonate, titanium dioxide and elevated amounts of plastic pigment. While the content of plastic pigment in the coating formulation plays a significant role in achieving high gloss, an equally important factor which contributes to the desired finished paper properties is the surface area of the paper which comprises plastic pigment. SEM micrographs of coated paper surfaces were analyzed for plastic pigment spheres on the surface of the paper. The number of spheres were counted and an approximate percent of the total area of the sheet was calculated. The results showed an effect of coating speed/coating solids on plastic sphere areas as a percent of surface area. It was noted that as coating speed increased, a greater amount of surface area was filled with plastic spheres producing greater gloss development. The reason for this is not clear, but one possible explanation is that at increasingly higher coating speeds, drying is more intense, and as water is driven from the coated surface during drying, the plastic spheres (being of equivalent density when filled with water and of lower density as water is evaporated), are transported through the coating to the surface of the coated paper. Therefore to achieve a target gloss, lower amounts of plastic pigment may be used when the method and speed of the coating application is taken into account.

In addition, the size of the plastic pigment plays a role in the performance of the coating, vis-a-vis gloss development.

For example, paper gloss achieved with a 0.45 micron diameter solid sphere plastic pigment is not as good as that obtained with a hollow sphere plastic pigment when the percent of surface area is taken into consideration. It is postulated that this ineffectiveness may be related to the diameter and curvature of the sphere presented to incoming light and subsequent light scattering. For example, five 0.45 micron diameter solid spheres will occupy approximately the same space as a 1.0 micron diameter hollow sphere. However, hollow spheres can flatten upon calendering and create a plurality of multiple flat surfaces for more efficient light reflection and gloss development. Meanwhile the use of a 0.20 micron diameter solid sphere plastic pigment will more closely simulate a flatter surface than the 0.45 micron diameter spheres because approximately twenty five 0.20 micron diameter spheres will occupy the same space as a single 1.0 micron diameter hollow sphere.

In summary, the preferred coating formulation for achieving the results of the present invention comprises from 46–60% calcium carbonate, 0–33% coating clay, 0–5.5% titanium dioxide and from 14–35% plastic pigment. The preferred plastic pigment is a hollow sphere plastic pigment having a particle size of up to 1.0 micron diameter selected from the group consisting of polystyrene, acrylics and methaecrylates. However, solid sphere plastic pigments ranging from 0.20–0.45 micron diameter may be substituted for the hollow sphere pigment or blended with the hollow sphere pigment as desired.

The preferred finishing step in the manufacture of the high gloss coated paper disclosed herein involves a supercalender apparatus operated at speeds ranging from about 800–2800 fpm, and at calender loads of from about 1500–2000 phi, with one or more rolls heated to a temperature of from about 100–240 degrees F. It should be noted, however, that gloss development equivalent to that obtained with a supercalender apparatus may be obtained with a gloss calender or soft roll calender under appropriate operating conditions.

BRIEF DESCRIPTION OF THE DRAWINGS

The FIGURE of drawing is a plot showing the percent surface area containing plastic pigment vs. the percent plastic pigment in the coating.

DETAILED DESCRIPTION

The present invention will be more fully understood by reference to the following Examples.

EXAMPLE 1

Coatings containing from 7% to 35% of a hollow sphere plastic pigment having a diameter of 1.0 micron (Rohm and Haas HP-1055), were applied onto base stock having 10.0 lb/rm precoat and no precoat. Coated paper samples were then supercalendered. Paper gloss and smoothness data are shown in Table 1. The 10.0 lb/rm precoated sample achieved a 75° paper gloss greater than 91 with 14% or more plastic pigment in the coating. 60° gloss was 62 to 75, and 20° gloss was 30 to 37 for the same samples. As the plastic pigment level was increased, higher gloss values could be achieved at lower coat weight. Print gloss also increased with increased levels of plastic pigment in the coating. For the uncoated base stock, 75° paper gloss values of 84–94 were obtained; 60° gloss was 48–58, and 20° gloss was 20–24. Finished smoothness was less than on precoated base stock, which is what would be expected. Compared to the cast coated control, gloss and smoothness values were met or exceeded.

TABLE 1

| Condition | % Coating Pigment | 75° Paper Gloss | 60° Paper Gloss | 20° Paper Gloss | Parker Print Surf @ 10 kg | Coat. Wt. lb/rm |
|---|---|---|---|---|---|---|
| | | Base Stock: 10.0-lb/rm precoat | | | | |
| 1 | 7 | 86 | 56 | 26 | 0.48 | 8.3 |
| 2 | 14 | 91 | 62 | 30 | 0.44 | 8.3 |
| 3 | 21 | 96 | 73 | 33 | 0.49 | 7.3 |
| 4 | 28 | 96 | 75 | 37 | 0.57 | 7.0 |
| 5 | 35 | 93 | 67 | 28 | 0.51 | 5.0 |
| | | Base Stock: no precoat | | | | |
| 6 | 7 | 84 | 49 | 20 | 0.67 | 9.6 |
| 7 | 14 | 89 | 52 | 20 | 0.65 | 8.5 |
| 8 | 21 | 89 | 48 | 22 | 0.68 | 7.0 |
| 9 | 28 | 93 | 58 | 24 | 0.66 | 7.1 |
| 10 | 35 | 94 | 48 | 24 | 0.64 | 6.5 |
| | | Cast Coated Example | | | | |
| | — | 84 | 53 | 22 | 0.53 | — |

EXAMPLE 2

Laboratory studies were conducted using 1.0 micron diameter hollow sphere pigment and 0.45 micron diameter solid bead plastic pigments. A pilot coater was used to apply the coatings at 800 fpm, supercalendering was done at 800 fpm. Base stock was precoated with either 8.8 lb/rm or 2.0 lb/rm coating prior to high gloss top coat application. Results are found in Tables 2 and 3. Supercalendering was less intense for this trial, resulting in overall lower gloss values than Example 1. For both base stocks, with hollow sphere plastic pigment (conditions 1, 2 and 3) at 15% or 21% total pigment, paper gloss, print gloss, and smoothness were better than or equal to the cast coated example. At weight percent addition levels comparable to the hollow sphere pigment, paper gloss using the 0.45 micron diameter solid bead pigment (conditions 4, 5, and 6) were lower than both the hollow sphere pigment data and cast coated data. However, print gloss and smoothness were equivalent. Using a mixture of hollow sphere and 0.45 micron solid sphere pigments, (conditions 7 and 8), resulted in properties equivalent to hollow sphere pigment alone.

TABLE 2

| Condition | % Coating Pigment | 75° Paper Gloss | 60° Paper Gloss | 20° Paper Gloss | Parker Print Surf @ 10 kg | Coat. Wt. lb/rm |
|---|---|---|---|---|---|---|
| | | Base Stock: 8.8 lb/rm precoat<br>Plastic Pigment: 1.0 micron diameter hollow sphere | | | | |
| 1 | 10 | 80 | 46 | 20 | 0.45 | 8.4 |
| 2 | 15 | 84 | 53 | 26 | 0.40 | 8.1 |
| 3 | 21 | 89 | 58 | 32 | 0.44 | 8.0 |

TABLE 2-continued

| Condition | % Coating Pigment | 75° Paper Gloss | 60° Paper Gloss | 20° Paper Gloss | Parker Print Surf @ 10 kg | Coat. Wt. lb/rm |
|---|---|---|---|---|---|---|
| | Plastic Pigment: 0.45 micron diameter solid bead | | | | | |
| 4 | 15 | 79 | 40 | 21 | 0.38 | 8.4 |
| 5 | 21 | 77 | 40 | 17 | 0.43 | 7.2 |
| 6 | 28 | 81 | 50 | 26 | 0.36 | 10.6 |
| | Plastic Pigment: 1.0 micron diameter hollow sphere and 0.45 micron diameter solid bead, HP:SB | | | | | |
| 7 | 15:7 | 86 | 55 | 28 | 0.42 | 7.5 |
| 8 | 14:14 | 86 | 52 | 28 | 0.59 | 8.1 |
| | | Cast Coated Example | | | | |
| | — | 84 | 53 | 27 | 0.53 | — |

TABLE 3

| Condition | % Coating Pigment | 75° Paper Gloss | 60° Paper Gloss | 20° Paper Gloss | Parker Print Surf @ 10 kg | Coat. Wt. lb/rm |
|---|---|---|---|---|---|---|
| | Base Stock: 2.0 lb/rm precoat Plastic Pigment 1.0 micron diameter hollow sphere | | | | | |
| 1 | 10 | 83 | 47 | 26 | 0.62 | 9.8 |
| 2 | 15 | 88 | 55 | 27 | 0.52 | 9.0 |
| 3 | 21 | 90 | 59 | 30 | 0.56 | 9.3 |
| | Plastic Pigment: 0.45 micron diameter solid bead | | | | | |
| 4 | 15 | 81 | 48 | 27 | 0.54 | 10.1 |
| 5 | 21 | 80 | 45 | 23 | 0.61 | 9.4 |
| 6 | 28 | 85 | 50 | 31 | 0.53 | 10.3 |
| | Plastic Pigment: 1.0 micron diameter hollow sphere and 0.45 micron diameter solid bead, HP:SB | | | | | |
| 7 | 15:7 | 89 | 60 | 32 | 0.47 | 10.3 |
| 8 | 14:14 | 90 | 60 | 35 | 0.52 | 10.6 |
| | | Cast Coated Example | | | | |
| | — | 84 | 53 | 27 | 0.53 | — |

EXAMPLE 3

Solid sphere plastic pigments with diameters of 0.20 micron and 0.45 micron diameter were compared. Weight percent of coating pigment was increased to 40% with the intent of improving the effectiveness of the 0.45 micron pigment. Table 4 shows that even at 40%, the 0.45 micron pigment was ineffective for gloss development. However, using the 0.20 micron bead at 40% addition gave a 75° paper gloss of 88 as shown in Table 4.

TABLE 4

| Condition | % Coating Pigment | 75° Paper Gloss | 60° Paper Gloss | Parker Print Surf @ 10 kg | Coat Wt. lb/rm |
|---|---|---|---|---|---|
| | Base Stock: 2.0 lb/rm precoat Plastic Pigment: 0.45 micron diameter solid bead, HP:SB | | | | |
| 1 | 40 | 79 | 41 | 0.76 | 11.1 |
| | Plastic Pigment: 0.20 micron diameter solid bead | | | | |
| 2 | 40 | 88 | 57 | 0.60 | 12.6 |

EXAMPLE 4

High gloss paper coatings containing about 20% hollow sphere plastic pigment were applied with a high speed commercial coater at 2500 to 2700 fpm. In ten trials, paper was supercalendered over a broad range of conditions. Calendar speed ranged from 1000 to 1400 fpm, heated roll internal temperatures were 100 to 240° F., and calender loads ranged from 1500 to 1900 pli. Typical results are shown in Table 5. Paper gloss and smoothness greater than or comparable to a cast coated sheet were obtained.

TABLE 5

| Condition | % Coating Pigment | 75° Paper Gloss | 60° Paper Gloss | 20° Paper Gloss | Parker Print Surf @ 10 kg | Coat. Wt. lb/rm |
|---|---|---|---|---|---|---|
| | Plastic Pigment 1.0 micron diameter hollow sphere Base Stock: 2.0 lb/rm precoat | | | | | |
| 1 | 20.8 | 97 | 71 | 44 | 0.62 | 9.0 |
| 2 | 20.8 | 93 | 67 | 34 | 0.64 | 9.0 |
| 3 | 20.8 | 94 | 67 | 38 | 0.66 | 9.0 |
| 4 | 20.8 | 96 | 69 | 44 | 0.65 | 9.0 |
| | | Cast Coated Example | | | | |
| — | — | 84 | 53 | 27 | 0.53 | — |

It will therefore be seen that the coated paper product of the present invention can be manufactured on existing high speed papermachines using conventional processes. The favorable effect of the plastic pigment to the coating is exhibited within the range of from about 14–35% addition. The most favorable effect is obtained with the use of hollow sphere plastic pigment having a diameter o about 1.0 micron. Gloss development of the product is achieved by the flattening of the plastic pigment particles between existing particles of other pigments during the calendering process.

While the prior art discloses in general the use of plastic pigments in paper coatings, none discloses the use of the elevated amounts required to achieve the results of the present invention. It is speculated that such pigments have only been sparingly used in the past because of cost considerations and the Theological problems encountered with the use of such pigments. Nevertheless, applicants' herein have managed to overcome these problems and create a product that is competitive with conventional cast coated products.

While the preferred forms of the invention have been described in the Examples, variations will be apparent to those skilled in the art. Thus the invention is not limited to the embodiments described and modifications may be made therein without departing from the spirit and scope of the invention as defined in the appended claims.

What is claimed is:

1. A high gloss coated paper having applied to at least one surface thereof the dried residue of from about 6 to 18 lbs/ream (ream size 3300 sq. ft) of an aqueous coating formulation, said coating formulation comprising:

a pigment composition comprising, by weight as coating pigments, about 0–33% coating clay, 46–60% calcium carbonate, and from about 14–35% of a hollow sphere plastic pigment, wherein 100% of the pigment composition equals 100 parts weight, from about 10 to 12 parts by weight binder per 100 parts pigment composition, and water in an amount sufficient to provide a coating formulation with a solids content of from about 45 to 60%;

said coated paper exhibiting a 75 degree paper gloss of at least about 90, a 60 degree paper gloss of at least about 55, a 20 degree paper gloss of at least about 35, and a Parker Print Surf of from about 0.44 to 0.65; wherein the high gloss characteristics of the coated paper are provided by finishing, after the coating has been applied, by passing the coated paper through a plurality of nips in a supercalender device at a load of from about 1500 to 2000 pli, wherein at least one of the nips includes a heated roll having a surface temperature of from about 100–240 degrees F. in contact with the coated surface of the paper.

2. Paper having high gloss and brightness suitable for printing high quality graphics wherein at least one surface thereof contains from about 6–18 lbs/ream of the dried residue of a coating formulation, said coating formulation including a pigment composition comprising coating clay, calcium carbonate and plastic pigment, said plastic pigment consisting essentially of hollow sphere bead particles ranging in size from about 0.20–1.0 micron, wherein at least about 18% of the said at least one surface of the paper contains plastic pigment to achieve a 75 degree paper gloss of at least about 90, a 60 degree paper gloss of at least about 55, a 20 degree paper gloss of at least about 35, and a Parker Print Surf of from about 0.44 to 0.65.

3. The coated paper of claim 1, in which the pigment in the dried residue of the coating formulation includes a solid sphere plastic pigment in addition to the hollow sphere plastic pigment.

4. The coated paper of claim 1, wherein the dried residue of the coating formulation further comprises titanium dioxide in an amount of up to about 5% by weight.

5. The coated paper of claim 1, wherein the dried residue is formed from an aqueous coating formulation that is applied at a coat weight of from about 2.0 lb./ream to about 10.0 lb./ream.

6. The paper of claim 2, in which the pigment in the dried residue of the coating formulation includes a solid sphere plastic pigment in addition to the hollow sphere plastic pigment.

* * * * *